US009415580B2

(12) United States Patent
Beech et al.

(10) Patent No.: US 9,415,580 B2
(45) Date of Patent: Aug. 16, 2016

(54) CARD PRODUCTION SYSTEM INSERTER WITH INSERT PRINTER

(71) Applicant: DATACARD CORPORATION, Minnetonka, MN (US)

(72) Inventors: Brian Beech, Bloomington, MN (US); Thomas J. Wagener, Shorewood, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 22 days.

(21) Appl. No.: 14/496,334

(22) Filed: Sep. 25, 2014

(65) Prior Publication Data

US 2015/0085047 A1 Mar. 26, 2015

Related U.S. Application Data

(60) Provisional application No. 61/882,401, filed on Sep. 25, 2013.

(51) Int. Cl.

| | |
|---|---|
| ***B41F 17/00*** | (2006.01) |
| ***B41J 2/01*** | (2006.01) |
| ***B41J 13/12*** | (2006.01) |

(52) U.S. Cl.

CPC . *B41F 17/00* (2013.01); *B41J 2/01* (2013.01); *B41J 13/12* (2013.01)

(58) Field of Classification Search

None

See application file for complete search history.

(56) References Cited

U.S. PATENT DOCUMENTS

| | | | | |
|---|---|---|---|---|
| 5,266,781 | A | 11/1993 | Warwick et al. | |
| 5,451,037 | A | 9/1995 | Lundstrom | |
| 5,588,763 | A | 12/1996 | Nubson | |
| 5,862,754 | A * | 1/1999 | Hill | B41J 11/58 101/228 |
| 6,902,107 | B2 | 6/2005 | Shay et al. | |
| 7,059,532 | B2 * | 6/2006 | McCumber | B65H 1/22 235/491 |
| 7,398,972 | B2 | 7/2008 | Schuller et al. | |
| 2009/0277808 | A1 | 11/2009 | Payne | |
| 2011/0247509 | A1 | 10/2011 | Choi | |
| 2012/0169037 | A1 | 7/2012 | White, III | |
| 2013/0181433 | A1 | 7/2013 | Hadlock | |
| 2013/0220984 | A1 | 8/2013 | Cronin et al. | |

OTHER PUBLICATIONS

International Search Report and Written Opinion for International Application No. PCT/US2014/057443, dated Sep. 25, 2014, 10 pgs.

Enhanced Datacard MXD Card Delivery System, Datacard Group, http://www.datacard.com; available at least as early as Sep. 25, 2014, 2 pgs.

(Continued)

*Primary Examiner* — An Do

*Assistant Examiner* — Renee I Wilson

(74) *Attorney, Agent, or Firm* — Hamre, Schumann, Mueller & Larson, P.C.

(57) ABSTRACT

Systems, mechanisms, and methods are described that relate to the production of a custom printed insert(s) that can be custom printed prior to insertion of the custom printed insert(s) into an envelope along with a personalized card/carrier combination for mailing to the intended holder of the personalized card. The inserts are custom printed using an insert printer that is located in the inserter mechanism that is used to insert the insert(s) and the card/carrier combination into an envelope for mailing to an end user of the card. The inserter mechanism can have an "off-line" configuration, i.e. configured as a stand-alone mechanism, or configured for "in-line" use, i.e. used together with other mechanisms.

12 Claims, 6 Drawing Sheets

(56) References Cited

OTHER PUBLICATIONS

DataCard MPR Series GSM Card Issuance Systems, Datacard Group, http://www.datacard.com; available at least as early as Sep. 25, 2014, 4 pgs.

Datacard MX1100 Card Issuance System, Datacard Group, http://www.datacard.com; available at least as early as Sep. 25, 2014, 4 pgs.

Datacard MXi Envelope Insertion System, Datacard Group, http://www.datacard.com; available at least as early as Sep. 25, 2014, 2 pgs.

* cited by examiner

CARD PRODUCTION SYSTEM INSERTER WITH INSERT PRINTER

FIELD

The technical disclosure herein relates to personalized plastic cards, such as financial cards including credit and debit cards, identification cards, driver's licenses, and other personalized plastic cards that are distributed to end users in mailed envelopes.

BACKGROUND

It is known to distribute personalized plastic cards to end users by mailing the cards in envelopes to the end users. The cards are typically affixed to a form which is mechanically folded and mechanically inserted into a mailing envelope in an inserter mechanism. In addition, one or more inserts including, but not limited to, promotional inserts, advertising inserts, terms and conditions inserts, and the like, may also be mechanically inserted into the envelope in the inserter mechanism along with the folded form bearing the card(s).

Currently, inserts are pre-printed and loaded into the inserter mechanism. There may be separate hoppers in the inserter for different types of inserts. However, if one wants to change the content of the inserts, for example changing the terms and conditions insert which can vary from state-to-state, the inserter must be shut down and loaded with the correct inserts. This results in downtime of the system which reduces throughput (i.e. the number of envelopes ready for mailing with inserted forms and inserts).

SUMMARY

Systems, mechanisms, and methods are described that relate to the production of a custom printed insert(s) that can be custom printed prior to insertion of the custom printed insert(s) into an envelope along with a personalized card/carrier combination for mailing to the intended user of the personalized card. The inserts are custom printed using an insert printer that is located in, or operably coupled to, the inserter mechanism that is used to insert the insert(s) and the card/carrier combination into an envelope for mailing to an end user of the card. The inserter mechanism can have an "off-line" configuration, i.e. configured as a stand-alone mechanism, or configured for "in-line" use, i.e. used together with other mechanisms.

In one embodiment, a card production system includes a card personalization system, a card fixing mechanism connected to the card personalization system, a form folding mechanism connected to the card fixing mechanism, and an inserter mechanism connected to the form folding mechanism. The inserter mechanism includes an insert printer which is used to print on the inserts so as to produce custom printed inserts within the inserter mechanism prior to inserting the inserts into envelopes for mailing.

In other embodiments, the system includes a card fixing mechanism, a form folding mechanism connected to the card fixing mechanism, and an inserter mechanism connected to the form folding mechanism. The inserter mechanism includes an insert printer which is used to print on the inserts so as to produce custom printed inserts within the inserter mechanism.

In another embodiment, an inserter mechanism is provided that is configured for use with a card production system. The inserter mechanism includes an insert hopper configured to contain a plurality of inserts, and an insert printer operatively connected to the insert hopper and configured to receive inserts from the hopper to print on the inserts and produce custom printed inserts. The inserter mechanism also includes an envelope hopper configured to contain a plurality of envelopes, and an inserting mechanism configured to insert at least one of the custom printed inserts into one of the envelopes.

In another embodiment, a method includes forming a card/carrier combination, feeding an insert from an insert hopper to an insert printing mechanism and printing on the insert using the insert printing mechanism to produce a custom printed insert, matching the custom printed insert with the card/carrier combination, and inserting the matched custom printed insert and the card/carrier combination into an envelope.

DRAWINGS

FIG. 1 schematically depicts a card production system with an inserter mechanism as described herein.

FIG. 2 schematically depicts the inserter mechanism described herein.

DETAILED DESCRIPTION

Systems, mechanisms, and methods are described relating to the production of a custom printed insert(s) that can be custom printed prior to insertion of the custom printed insert(s) into an envelope along with a personalized card/carrier combination for mailing to the intended user of the personalized card. The personalized card can be any type of card that is personalized for the intended user of the card, and that is mailed to the intended user. Examples of personalized cards include, but are not limited to, plastic cards such as financial cards including credit and debit cards, identification cards, driver's licenses, retail loyalty cards, and other personalized plastic cards that are distributed to end users via mail.

Figure 1:
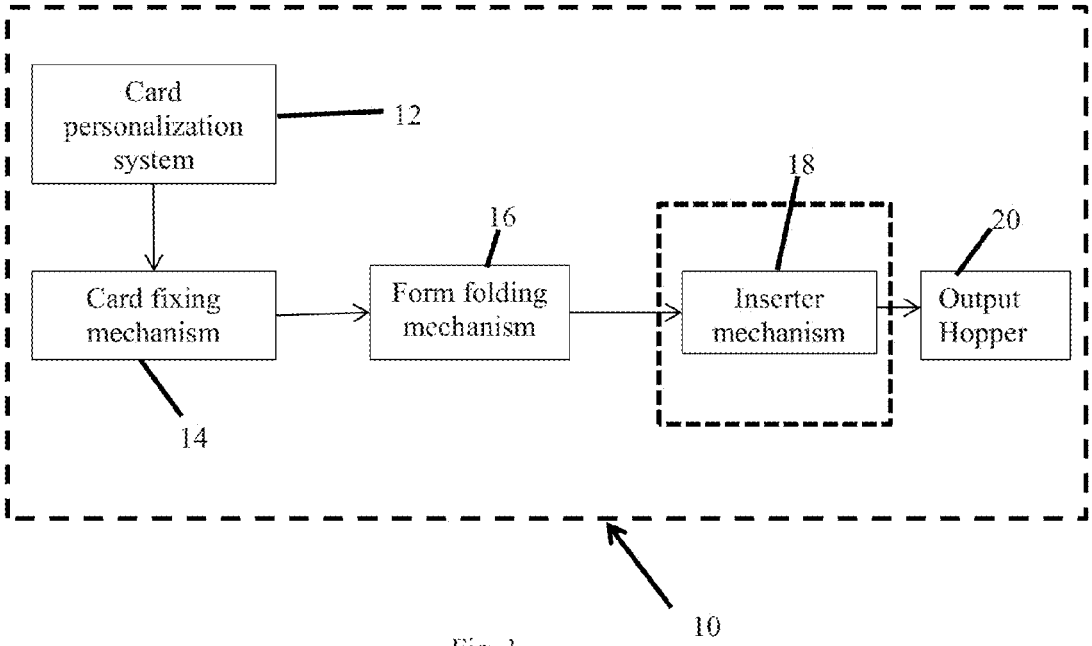

FIG. 1 illustrates an example of a card production system 10 in one possible embodiment. In this example, the system 10 includes a card personalization system 12, a card fixing mechanism 14, a form folding mechanism 16, an inserter mechanism 18 and an output hopper 20.

The card personalization system 12 can be any system that is designed to perform one or more personalization and/or processing operations on plastic cards. Examples of personalization and/or processing operations include, but are not limited to, printing, programming a magnetic stripe or an integrated circuit chip, laminating, embossing, laser personalization, indent printing, and the like, all of which are well known in the art. Examples of the type of personalization that can be added to the card include, but are not limited to, the user's name, the user's address, a photograph of the user, an account number assigned to the user, and other types of data well known to those of ordinary skill in the art.

The card personalization system 12 is often referred to as a central issuance system that is often room sized, configured with multiple personalization/processing stations or modules performing different personalization/processing tasks, and that is generally configured to process multiple cards at once in relatively high processing volumes (for example, on the order of hundreds or thousands per hour). An example of a central issuance system is the MX and MPR line of card issuance systems available from DataCard Corporation of Minnetonka, Minn. Central issuance systems are described in U.S. Pat. Nos. 6,902,107, 5,588,763, 5,451,037, and 5,266,781 which are incorporated by reference herein in their entirety.

In one embodiment, cards that are processed by the card personalization system 12 are mechanically input directly into the card fixing mechanism 14 for further processing. In this embodiment, the card personalization system 12 is considered to be "in-line" with the card fixing mechanism 14, or in other words mechanically in-line with the card fixing mechanism 14 so that cards that are output from the card personalization system 12 can be transported by mechanical transport mechanisms, for example rollers, into the card fixing mechanism 14. This embodiment tends to permit high throughput of cards since the cards do not need to be manually carried from an output of the card personalization system 12 and manually input into the card fixing mechanism 14. The integration of card personalization systems with card fixing mechanisms 14 is well known in the art, for example from the MXD™ card delivery system available from DataCard Corporation of Minnetonka, Minn.

In another embodiment, the card personalization system 12 can be separate from, or "off-line" from, the card fixing mechanism 14 so that cards that are processed by and output from the card personalization system must be manually input into the card fixing mechanism 14.

The card fixing mechanism 14 is a mechanism of a type that is known in the art that attaches one or more of the processed cards to a carrier form. The mechanism 14 can include a hopper for pre-printed carrier forms, which are fed individually from the hopper and mated with the card(s) in known manner, for example using an adhesive. In an embodiment, the mechanism 14 can include a carrier forms printer that can print on each form before or after the card(s) is mated with the form. An example of a suitable card fixing mechanism is the fixing mechanism used in the MXD™ card delivery system available from DataCard Corporation of Minnetonka, Minn.

After the card(s) is affixed to the form, the card/form combination is mechanically transported to the form folding mechanism 16 of a type that is also known in the art. The form folding mechanism is configured to fold the carrier form into a size suitable for mailing. An example of a suitable form folding mechanism is the folding mechanism used in the MXD™ card delivery system available from DataCard Corporation of Minnetonka, Minn. The form folding mechanism 16 can be a mechanism that is completely separate from, but mechanically affixed to, the card fixing mechanism 14, such as being a separate module. Alternatively, the form folding mechanism 16 can be physically incorporated into the card fixing mechanism 14 so that they are considered a single unit with one another. Any construction and/or location of the form folding mechanism 16 can be used as long as the form folding mechanism can receive card/form combinations and fold the form for subsequent mailing.

Figure 2:
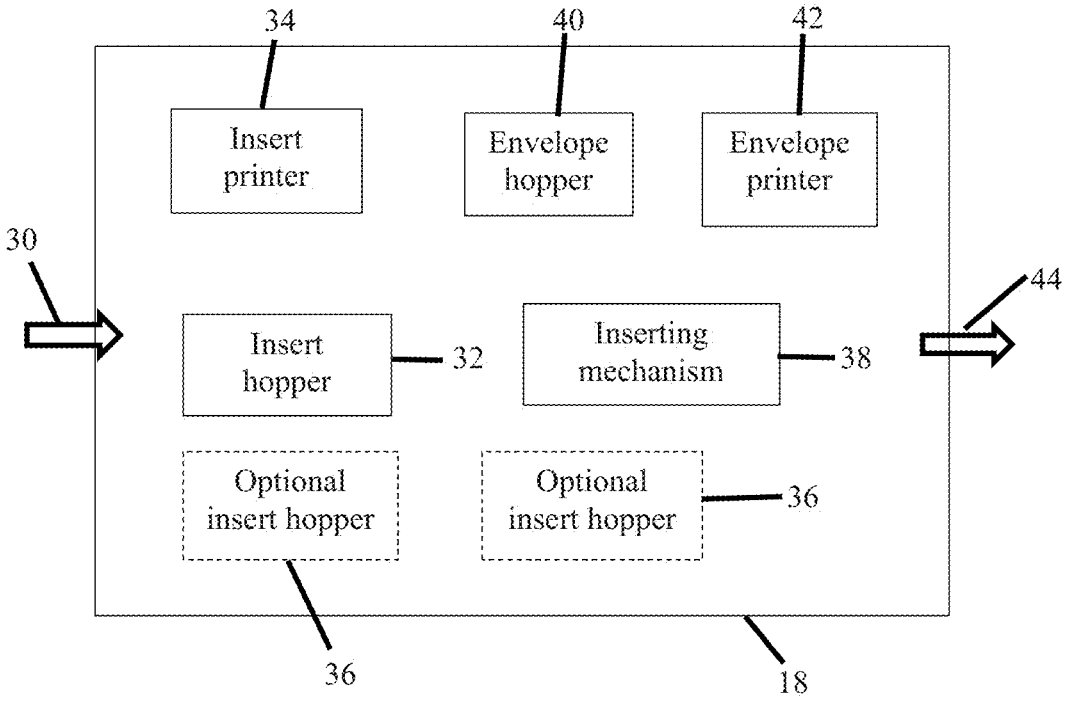

After folding, the folded card/carrier combination is mechanically transported to the inserter mechanism 18. The inserter mechanism 18, which is discussed further below with respect to FIG. 2, is configured to print on one or more inserts which are inserted into an envelope with the folded card/carrier combination. The inserter mechanism 18 is illustrated as being incorporated in-line with the card fixing mechanism 14 and the form folding mechanism 16 so that the mechanical transport mechanism can transport the folded card/carrier combinations into the inserter mechanism 18. However, in another embodiment as indicated by the dashed lines in FIG. 1, the inserter mechanism 18 can be a mechanism that is physically separate from the card fixing mechanism 14 and the form folding mechanism 16, and the folded card/carrier combinations are manually carried from the folding mechanism and manually inserted into a feed mechanism of the inserter mechanism that feeds the card/carrier combinations one-by-one into the inserter mechanism.

The general construction of inserter mechanisms that can insert card/carrier combinations and pre-printed inserts into envelopes is known in the art. But the known inserter mechanisms do not include the ability to custom print inserts.

With reference to FIG. 2, the inserter mechanism 18 includes an input 30 through which folded card/carrier combinations can be input one-by-one. The inserter mechanism 18 also includes at least one insert hopper 32 that is configured to hold a plurality of inserts that are to be printed on to produce custom printed inserts. Inserts are fed one-by-one from the hopper 32 to an insert printer 34 which prints on the inserts, the result being custom printed inserts. Optionally, one or more additional insert hoppers 36 can be provided which can contain additional inserts, for example of the same type as in the hopper 32 or different inserts.

The inserts can be pre-printed with certain information with the printer 34 applying additional printing to the inserts. Alternatively, the inserts can be completely or substantially blank and the printer 34 applies all of the appropriate printing to the inserts. The printing on the inserts can be text, graphics or combinations thereof. The inserts are typically of envelope size or less, sufficient to allow the custom inserts to fit into mailing envelopes without folding. However, if the envelope is large enough, the custom inserts can be larger than envelope size, for example 8.5×11 or A4 size. Alternatively, if larger size inserts are used, an insert folding mechanism can be utilized in the inserter mechanism to fold the custom inserts down to an appropriate size.

The printer 34 can be any type of printer that is suitable for applying print, for example text, graphics, or the like, to the inserts. Examples of suitable printers include, but are not limited to, ink jet, laser, thermal, dot matrix, and the like. The printer can 34 can be configured to print monochromatic or multi-color. In one embodiment, the printer can be an ink jet printer with a fixed head, with the insert being transported past the fixed head during printing. In another embodiment, the ink jet printer uses a scanning head whereby the insert remains fixed during printing while the scanning head moves relative to the insert. However, the use of a fixed head (as opposed to a scanning head) increases the speed of the printer. In one embodiment, the printer 34 is of a type that can print at a target speed of between about 1,000 to about 10,000 inserts/hour. In another embodiment, the printer 34 is of a type that can print at a target speed of between about 1,500 to about 4,000 inserts/hour.

FIG. 2 schematically depicts the insert hopper 32 as being physically separate from the insert printer 34. The insert hopper 32 and the insert printer 34 can be formed as physically separate mechanisms or the insert hopper 32 and the insert printer 34 can be incorporated together into a single physical unit. Likewise, the optional insert hopper(s) 36 (if used) can be either physically separate from the insert printer 34 or incorporated together into a single physical unit with the insert printer 34.

In addition, although the insert printer 34 and the insert hopper 32 are illustrated as being part of the inserter mechanism 18 as a whole, the insert printer and the insert hopper could be part of a structure that is physically separate from the inserter mechanism 18. For example, the insert printer and insert hopper could form their own module which is connected to a module containing the remainder of the inserter mechanism 18.

After printing, the custom printed inserts are transported by a transport mechanism of a type known in the art to an inserting mechanism 38 which inserts the custom inserts into an envelope for mailing. The folded card/carrier combinations are also transported to the inserting mechanism 38 by the same or different transport mechanism and the folded card/carrier combinations are also inserted into the envelopes. The envelopes are mechanically fed one-by-one from an envelope hopper 40 that contains a plurality of envelopes. An envelope printer 42 of a known type is also provided for printing on the envelopes, for example printing a mailing address. The envelope printer 42 is located downstream of the insert printer 34 because the printing of the insert(s) needs to occur before the insert reaches the inserting mechanism 38. The envelope printer 42 can print on the envelopes prior to the envelopes being fed to the inserting mechanism 38 or after the card/carrier combinations and inserts have been inserted into the envelopes.

The folded card/carrier combination and the insert(s) suitable therefore can be matched together prior to reaching the inserting mechanism and inserted together at the same time into the envelope. Alternatively, the folded card/carrier combination and the insert(s) suitable therefore can be separately inserted into the envelope.

The now completed envelopes are then output from the inserter mechanism 18 via an output 44 to the output hopper 20 which gathers the envelopes for subsequent mailing.

Figure 3:
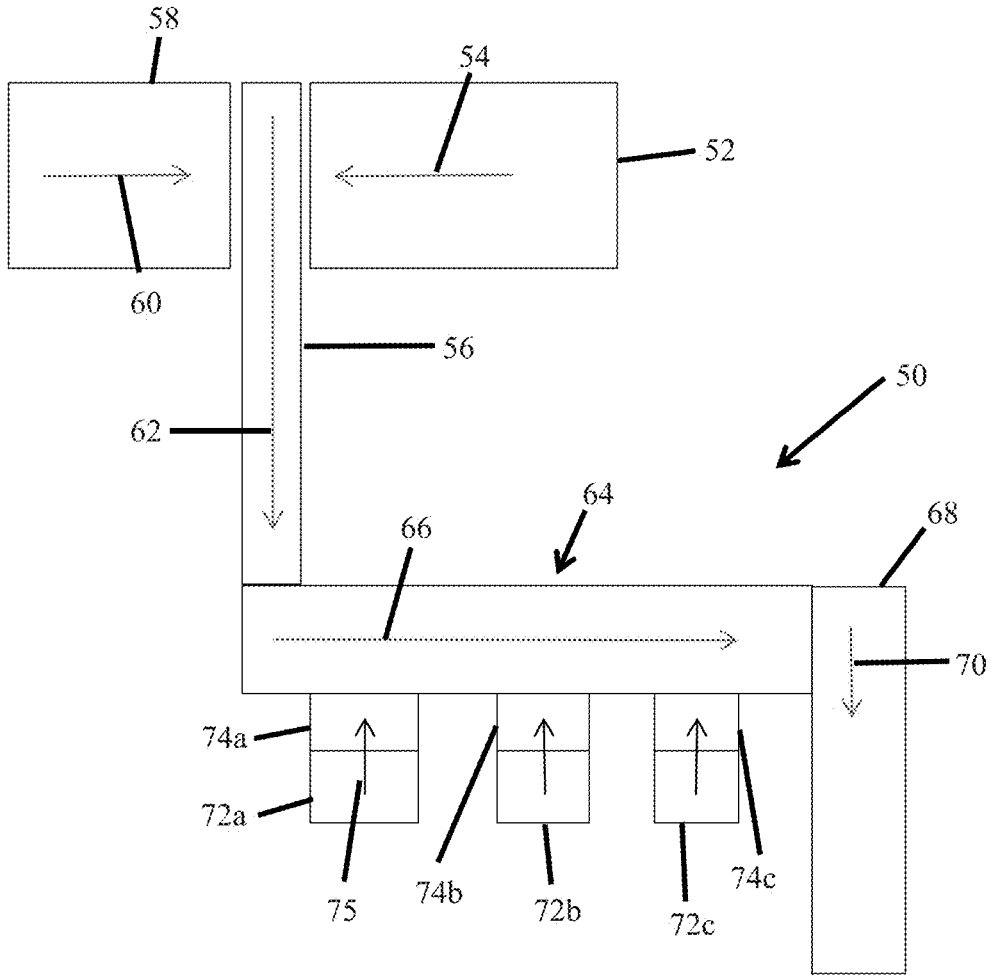
FIG. 3 is a schematic illustration of another embodiment of a card production system with an inserter mechanism as described herein.

FIG. 3 illustrates another example of a card production system 50. The system 50 includes a card personalization system 52 which can be of the type described above for the system 12. One example of the system 52 can be the MXD™ card delivery system available from DataCard Corporation of Minnetonka, Minn. Cards that are being personalized in the system 52 are fed generally in the direction of the arrow 54 and ultimately output into a transition module 56.

A carrier form to which a card or cards personalized in the system 52 are attached is printed in a forms printer 58. An example of a forms printer is described in U.S. Pat. No. 7,059,532 the entire contents of which are incorporated herein by reference. The forms printer 58 includes a hopper containing carrier forms to be printed on, and a printer mechanism that prints on the carrier forms. The carrier forms can be printed with any text, graphics or other data that one wishes to add to the carrier forms. Examples of data that can be printed on the carrier forms include the names and addresses of the cardholders corresponding to the cards to be attached to the carrier forms. The carrier sheets are fed generally in the direction of the arrow 60 in the forms printer 58 and ultimately output into the transition module 56.

In the transition module 56, the appropriate card(s) is matched with and attached to the appropriate carrier form to form a card/carrier combination. In addition, the card/carrier combination can be folded in the transition module 56, and the card/carrier combination is transported generally in the direction of the arrow 62. So the transition module 56 is configured to perform the functions of fixing one or more cards to a card carrier, and folding the card/carrier combinations.

The folded card/carrier combinations are then output to an inserter mechanism 64. In the inserter mechanism 64, the card/carrier combinations can be matched with one or more appropriate custom printed inserts and/or regular inserts, for example the insert(s) can be stacked on top of the card/carrier combination, as the card/carrier combination travels generally in the direction of the arrow 66 along an insertion track. At the end of the insertion track, the stack that includes the card/carrier combination and any insert(s) are placed into an envelope in an inserting mechanism 68 and the completed envelopes are stacked in the direction of the arrow 70 in the inserting mechanism 68. An example of a mechanism for inserting card/carrier combinations and inserts into envelopes is the MXi™ Envelope Insertion System available from DataCard Corporation of Minnetonka. Minn.

As shown in FIG. 3, the inserter mechanism 64 can include a plurality of hoppers 72*a*, 72*b*, 72*c* each of which can contain a plurality of inserts to be printed on. The illustrated example shows three hoppers 72*a-c*, although a larger or smaller number of hoppers can be used. In addition, one or more of the hoppers can contain inserts that are not printed on, but are instead matched with the card/carrier combination without printing on the inserts. The hoppers 72*a-c* feed inserts one by one to respective insert printing mechanisms 74*a*, 74*b*, 74*c*, for example in the direction of the arrows 75 in FIG. 3. Each insert printing mechanism 74*a-c* includes at least one printer that prints on the inserts that are fed from the hoppers 72*a-c* to produce custom printed inserts.

The printer(s) used in the printing mechanism 74*a-c* can be any type of printer that is suitable for applying print, for example text, graphics, or the like, to the inserts. Examples of suitable printers include, but are not limited to, ink jet, laser, thermal, dot matrix, combinations thereof, and the like. The printer(s) can be configured to print monochromatic or multicolor. In one embodiment, the printer(s) can be an ink jet printer with a fixed head, with the insert being transported past the fixed head during printing. In another embodiment, the ink jet printer uses a scanning head whereby the insert remains fixed during printing while the scanning head moves relative to the insert. However, the use of a fixed head (as opposed to a scanning head) increases the speed of the printer(s). In one embodiment, the printer is of a type that can print at a target speed of between about 1,000 to about 10,000 inserts/hour. In another embodiment, the printer is of a type that can print at a target speed of between about 1,500 to about 4,000 inserts/hour.

The inserts in any of the hoppers 72*a-c* can be pre-printed with certain information with the respective printing mechanism 74*a-c* applying additional printing to the inserts. Alternatively, the inserts can be completely or substantially blank and the printing mechanism 74*a-c* applies all of the appropriate printing to the inserts. The printing on the inserts can be text, graphics or combinations thereof. The inserts are typically of envelope size or less, sufficient to allow the custom printed inserts to fit into mailing envelopes without folding. However, if the envelope is large enough, the custom inserts can be larger than envelope size, for example 8.5×11 or A4 size. Alternatively, if larger size inserts are used, the inserter mechanism 64 can include an insert folding mechanism associated with each printing mechanism 74*a-c* that can be utilized before or after printing to fold the custom inserts down to an appropriate size.

The data printed by the printing mechanisms 74*a-c* on the inserts can be variable data or non-variable data. Variable data is data that varies with each custom insert or with each card/carrier combination, or data that is unique to or associated with the cardholder to whom the card(s) attached to the carriers are being sent. For example, the variable data can include, but is not limited, the cardholders name and/or address. If variable data is to be added, the printing mechanisms 74*a-c* can interface with a controller that controls the card personalization system 52 in order to receive the cardholder or other variable data from the controller.

Non-variable data can be data that is common to a number of custom inserts. For example, the non-variable data can include a company logo that is added to each insert, terms and conditions information that may vary from state to state, advertising or promotional information for a business, or the like.

In addition, each printing mechanism 74*a-c* of the inserter mechanism 64 can include a buffer mechanism that buffers (i.e. temporarily stores) the custom inserts. A buffer can be useful in the event that upstream systems, such as the system 52, the forms printer 58 or the transition module 56, or downstream systems such as the inserting mechanism 68 are shut down, for example due to an error condition. A buffer can also be useful when the printing mechanisms 74*a-c* are printing faster than the card/carrier combinations are being fed to the inserter mechanism 64 and/or faster than the card/carrier combinations are being transported in the inserter mechanism 64. U.S. Pat. No. 7,059,532, which is incorporated herein by reference in its entirety, describes the concept of a buffer used on a card carrier forms printer. A buffer mechanism for each printing mechanism 74*a-c* could operate and function in a similar manner.

Each printing mechanism 74*a-c* can also include an associated diverter and reject bin to hold and store defectively printed inserts or inserts that one does not wish to match with a card/carrier combination.

As described above, each printing mechanism 74*a-c* can include a single printhead or dual printheads. The use of dual printheads permits printing to occur on front and back sides of the inserts from the hoppers 72*a-c*. Two-sided printing on the inserts can also be accomplished using a single printhead. However, the use of two printheads is believed to result in faster throughput or rate of printing on the inserts. In the case of two-sided printing, a flipping mechanism can be provided, depending upon the type of printheads that are used, to flip the inserts for printing on the front and back sides of the inserts. The flipping mechanism can take any form that is suitable for flipping or reorienting the insert to allow access to the front and back sides by the printheads.

Figure 4:
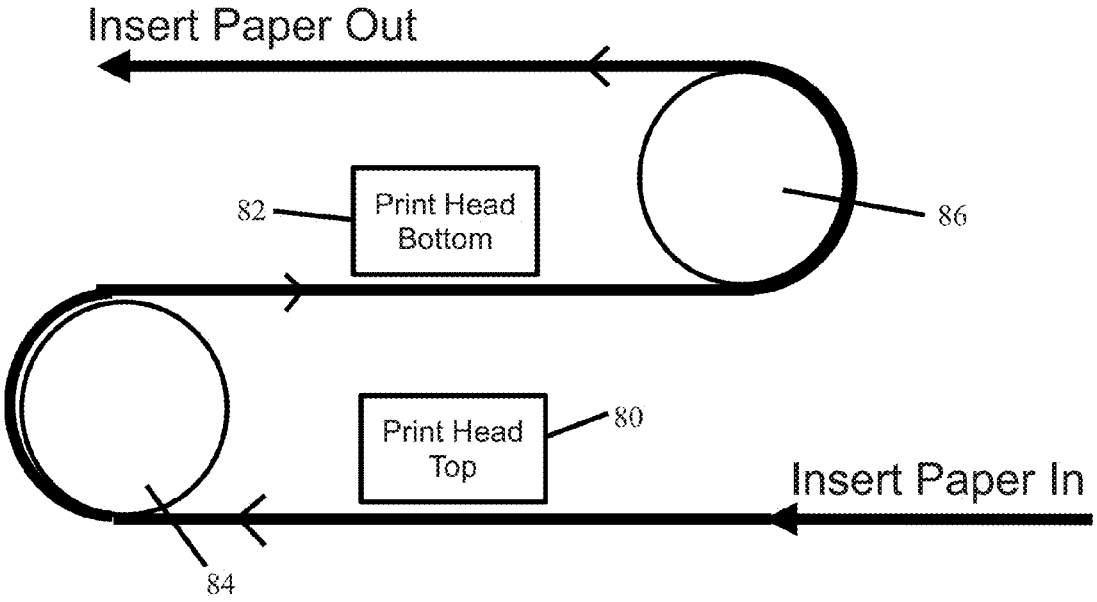
FIG. 4 is a schematic illustration of a portion of an inserter mechanism according to one embodiment.

FIG. 4 illustrates an example of a printing mechanism that can be used in the inserter mechanism 64 where two printheads 80, 82 are used in order to print on front and back sides of the inserts. In this example, an insert is fed from the hopper 72*a-c* past the first printhead 80 which performs printing on one side of the insert, for example on the top or front side. The insert is then fed around a roller 84 which reverses the direction of travel of the insert and flips the insert for printing by the second printhead 82. The insert is then fed past the second printhead 82 which performs printing on the opposite side of the insert, for example on the bottom or back side. The insert is then fed around a second roller 86 so that the insert is now travelling in its original direction for ultimate matching with the appropriate card/carrier combination. In this example, the printheads 80, 82 can be inkjet printheads. The embodiment in FIG. 4 employs a serpentine transport path for the inserts in order to achieve printing on both sides of the inserts.

Figure 5:
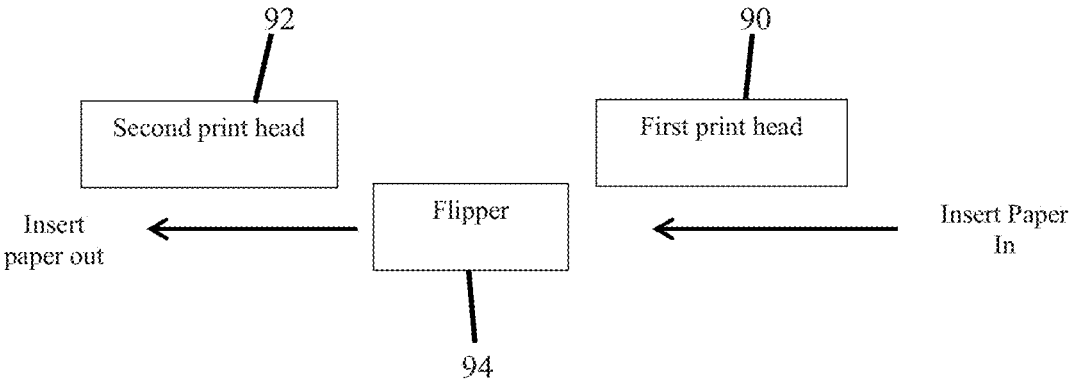
FIG. 5 is a schematic illustration of a portion of an inserter mechanism according to another embodiment.

FIG. 5 illustrates an example of a printing mechanism that can be used in the inserter mechanism 64 where two printheads 90, 92 are used in order to print on front and back sides of the inserts. Unlike FIG. 4, the embodiment in FIG. 5 employs a linear transport path for the inserts. In this example, an insert is fed from the hopper 72*a-c* past the first printhead 90 which performs printing on one side of the insert, for example on the top or front side that faces the printhead 90. The insert is then fed to a flipper mechanism 94 that flips the insert. The insert is then fed past the second printhead 92 which performs printing on the opposite side of the insert, for example on the bottom or back side which now faces upward toward the second printhead 92. The insert is then fed for ultimate matching with the appropriate card/carrier combination. In this example, the printheads 90, 92 can be inkjet printheads. The flipper mechanism 94 can be similar in construction and function to a card flipper mechanism of known construction and operation used to flip a card in a card personalization mechanism. Examples of card flipping mechanisms in a card personalization mechanism can be found in U.S. Pat. No. 7,398,972 and in US 2013/0220984 each of which is incorporated by reference herein in its entirety.

Depending upon the type of printheads being used and the type of printing being performed by the printheads, the insert may not need to be flipped in order to print on both the front and back sides. For example, for printing that does not rely upon gravity, for example a laser or a thermal head and thermal print ribbon, one printhead could be arranged on one side of the insert transport path to print on one side of the insert, while the second printhead can be located on the opposite side of the insert transport path to print on the opposite side of the insert.

Figure 6:
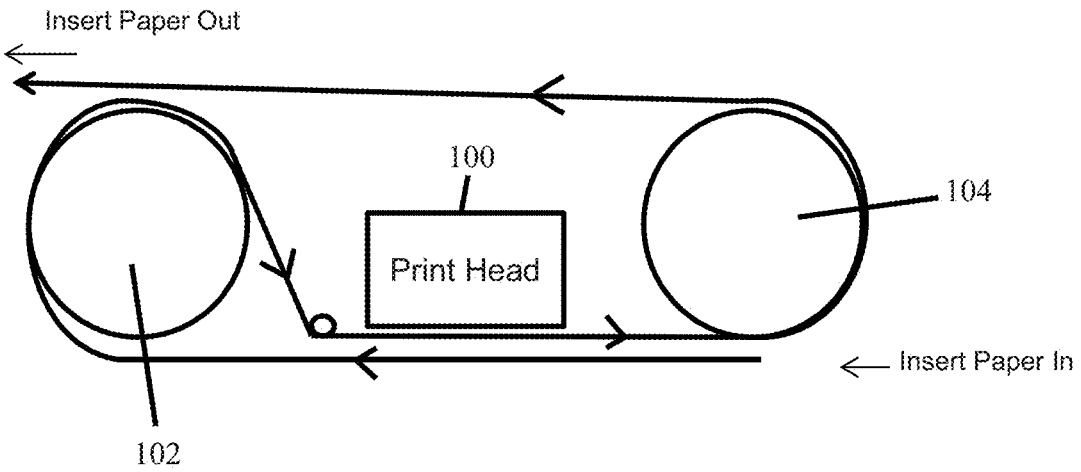
FIG. 6 is a schematic illustration of a portion of an inserter mechanism according to another embodiment.

FIG. 6 illustrates an example of a printing mechanism that can be used in the inserter mechanism 64 where one printhead 100 is used in order to print on front and back sides of the inserts. In this example, an insert is fed from the hopper 72*a-c* past the printhead 100 which performs printing on one side of the insert, for example on the top or front side. The insert is then fed around a roller 102 to reverse the direction of travel of the insert and flip the insert. The now flipped insert is then fed in the reverse direction past the printhead 100 to print on the opposite side of the insert, for example on the bottom or back side. The insert is then fed around a second roller 104 so that the insert is now travelling in its original direction for ultimate matching with the appropriate card/carrier combination. In this example, the printhead 100 can be an inkjet printhead.

Although the use of one or two printheads has been described, a larger number of printheads can be used. For example, two printheads could be designed for printing text, while a third printhead could be designed for printing graphics such as logos or photographs.

In addition, although the insert is described as being printed on both sides by either one or two printheads, the two printheads can be used to print on the same side of the insert and the insert need not be flipped. For example, one printhead can be provided for printing text on one side of the insert, while the second printhead can be provided for printing graphics on the same side of the insert.

One or more of the custom printed inserts printed by the printing mechanisms 74*a-c* are matched with the folded card/carrier combinations as the card/carrier combinations are transported along the insertion track of the inserter mechanism 64. At the end of the insertion track, the stack that includes the card/carrier combination and any insert(s) are placed into an envelope in the inserting mechanism 68 and the completed envelopes are then stacked in the inserting mechanism 68.

Figure 7:
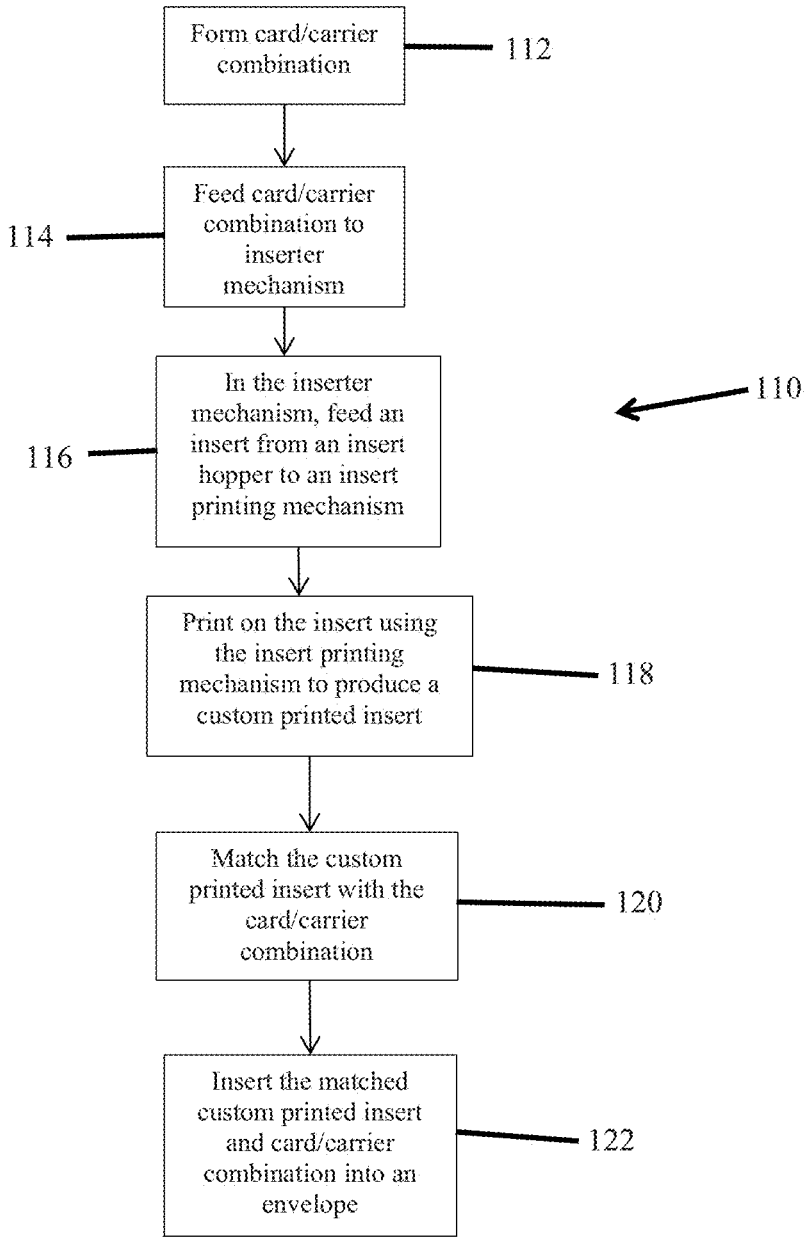
FIG. 7 illustrates a method according to one embodiment described herein.

FIG. 7 illustrates an embodiment of a method 110 described herein. In this method 110, a card/carrier combination is formed at block 112. As described above, the card/carrier combination is formed by the card personalization system producing one or more personalized cards, the card carrier printer printing a card carrier, and the card fixing mechanism/transition module attaching the card(s) to the card carrier to produce the card/carrier combination. If necessary, the card/carrier combination can also be folded. At block 114, the card/carrier combination is then fed to the inserter mechanism.

At block 116, in the inserter mechanism, an insert is fed from at least one of the insert hoppers to its associated insert printing mechanism. As described above, a plurality of inserts can be fed from the plurality of insert hoppers to the associated insert printing mechanisms. At block 118, the insert that is fed from the insert hopper is then printed on by the insert printing mechanism for that insert hopper to produce the custom printed insert.

The feeding of the insert(s) and the printing on the insert(s) can occur in concert with formation of the card/carrier combination. The language "in concert with" means that the feeding and the printing is synchronized with the formation of the card/carrier combination so that when the card/carrier combination reaches the inserter mechanism 64, the custom printed insert(s) is ready or near ready for matching with the appropriate card/carrier combination. However, in some embodiments, the feeding and printing of the inserts can occur before formation of the card/carrier combination. The technology for synchronizing operations of card/carrier combination formation and plain insert matching is well known in the art.

At block 120, the custom printed insert(s) is output from the insert printing mechanism(s) and matched with the card/carrier combination as the card/carrier combination is transported along the insertion track of the inserter mechanism.

At block 122, the matched custom printed insert and the card/carrier combination are then inserted into an envelope in the inserting mechanism and the envelope stacked for subsequent mailing.

The embodiments disclosed in this application are to be considered in all respects as illustrative and not limitative. The scope of the claimed invention is indicated by any appended claims rather than by the foregoing description, and all changes which come within the meaning and range of equivalency of the claims are intended to be embraced therein.

The invention claimed is:

1. A card system, comprising:

a card fixing mechanism that is configured to attach one or more personalized cards to an associated carrier form to produce a card/carrier combination;

a form folding mechanism connected to the card fixing mechanism and receiving the card/carrier combination therefrom, the form folding mechanism is configured to fold the card/carrier combination and output the folded card/carrier combination; and an inserter mechanism connected to the form folding mechanism and receiving the folded card/carrier combination therefrom, the inserter mechanism includes at least one hopper that is configured to contain a plurality of inserts to be printed on and an insert printing mechanism associated with the hopper and receiving an insert from the hopper to print on the received insert to produce a custom printed insert, and the inserter mechanism is configured to match the custom printed insert with the folded card/carrier combination.

2. The card system of claim 1, wherein the insert printing mechanism includes two printheads and a flipping mechanism configured to flip an insert.

3. The card system of claim 2, wherein the flipping mechanism is located between the two printheads along a direction of travel of the insert in the insert printing mechanism.

4. The card system of claim 2, wherein the printheads are inkjet printheads.

5. The card system of claim 4, wherein each inkjet printhead is oriented such that it faces downward toward a travel path of the insert located beneath the respective inkjet printhead.

6. The card system of claim 1, wherein the insert printing mechanism can print from about 1500 to about 4000 custom printed inserts per hour.

7. The card system of claim 1, wherein the insert printing mechanism includes two printheads and a roller configured to guide an insert from one of the printheads to the other printhead, wherein the roller is located between the two printheads along a direction of travel of the insert in the insert printing mechanism.

8. The card system of claim 1, the custom printed insert is printed with variable data, the plastic card of the card/carrier combination includes variable data, and the variable data that is printed on the custom printed insert corresponds to at least a portion of the variable data on the plastic card.

9. The card system of claim 1, further comprising a carrier forms printer connected to the card fixing mechanism and that is configured to print on carrier forms and output printed carrier forms to the card fixing mechanism to produce the card/carrier combination.

10. The card system of claim 1, further comprising a card personalization system that is configured to produce the personalized plastic cards, the card personalization system is mechanically connected in-line to the card fixing mechanism so as to be able to mechanically output the personalized plastic cards to the card fixing mechanism.

11. The card system of claim 10, wherein the card personalization system can personalize at least 1000 cards per hour.

12. The card system of claim 1, further comprising a card personalization system that is configured to produce the personalized plastic cards, and the card personalization system is off-line from the card fixing mechanism so that the personalized plastic cards from the card personalization are manually input into the card fixing mechanism.

* * * * *